US009239197B1

(12) United States Patent
Christensen

(10) Patent No.: US 9,239,197 B1
(45) Date of Patent: Jan. 19, 2016

(54) COMPOSITE AMMUNITION MAGAZINE FOR FIREARM

(71) Applicant: TDJ, Inc., Fayette, UT (US)

(72) Inventor: Jason Christensen, Gunnison, UT (US)

(73) Assignee: TDJ Incorporated, Fayette, UT (US)

( * ) Notice: Subject to any disclaimer, the term of this patent is extended or adjusted under 35 U.S.C. 154(b) by 0 days.

(21) Appl. No.: 14/335,628

(22) Filed: Jul. 18, 2014

(51) Int. Cl.
*F41A 9/65* (2006.01)

(52) U.S. Cl.
CPC ..... *F41A 9/65* (2013.01)

(58) Field of Classification Search
CPC ..... F41A 9/65; F41A 9/69; B32B 5/26
USPC ..... 42/50
See application file for complete search history.

(56) References Cited

U.S. PATENT DOCUMENTS 283,122 A * 8/1883 Lewis ..... 42/50
7,373,751 B1 5/2008 Schaffer
7,533,483 B1 5/2009 Alzamora et al.
8,069,601 B1 * 12/2011 Fitzpatrick et al. ..... 42/50
8,522,467 B1 * 9/2013 Christensen et al. ..... 42/71.01
8,796,163 B2 * 8/2014 Okada ..... 442/269

OTHER PUBLICATIONS

TI25 Advanced Composite Steel Lip Magazine for Ruger 10/22; Tactical Innovations Inc.; Accessed Nov. 10, 2009.

* cited by examiner

*Primary Examiner* — Troy Chambers
*Assistant Examiner* — Joshua Semick
(74) *Attorney, Agent, or Firm* — Thorpe, North & Western, LLP

(57) ABSTRACT

A composite ammunition magazine comprises a box with a follower slidably disposed in the box and a spring disposed between a bottom of the box and the follower and biasing the follower towards an open top. A pair of opposite lips extends from proximal ends at opposite sides of the open top in an arc to distal free ends over the open top of the box. The box and the pair of lips comprise a composite material comprising fibers in a resin matrix with the sides of the box comprising hoop fibers oriented at 0 degrees and axial fibers oriented at 90 degrees, and the pair of lips comprising lateral fibers oriented at 0 degrees and arc fibers extending in an arc and oriented at 90 degrees with respect to the lateral fibers. The pair of lips comprises more arc fibers than the axial fibers in the box.

20 Claims, 3 Drawing Sheets

COMPOSITE AMMUNITION MAGAZINE FOR FIREARM

BACKGROUND

1. Field of the Invention

The present invention relates generally to an ammunition magazine for a firearm.

2. Related Art

Shooting is a popular sport and some shooters enjoy customizing and/or improving their firearms. Some shooters actively seek to lighten the weight and/or improve the strength of their firearms and/or firearm accessories. The improvement of firearms and firearm accessories is an ongoing endeavor.

SUMMARY OF THE INVENTION

It has been recognized that it would be advantageous to develop an ammunition magazine with reduces weight, and/or increased strength. In addition, it has been recognized that it would be advantageous to develop a composite ammunition magazine.

The invention provides a composite ammunition magazine to hold ammunition for a firearm. The magazine comprises a box with sides and bottom, and an open top, and defining a longitudinal axis through the bottom and open top of the box, and having an interior sized and shaped to receive ammunition. A pair of opposite lips extends from opposite sides of the open top and over the open top of the box, and has a narrower gap between distal free ends of the pair of lips with respect to a wider width of the box between the sides of the box. A follower is slidably disposed in the box and has a path of travel substantially along the longitudinal axis. A spring is disposed between the bottom and the follower and biases the follower towards the open top. The box and the pair of lips comprise a composite material comprising fibers in a resin matrix. The sides of the box comprise more hoop fibers than the pair of lips in a hoop direction laterally around the box with respect to the longitudinal axis. The pair of lips comprises more axial fibers than the sides of the box in an axial direction substantially along the longitudinal axis.

In addition, the invention provides an ammunition magazine to hold ammunition for a firearm. The magazine comprises a box with substantially enclosed sides and bottom, and an open top, and defining a longitudinal axis through the bottom and the open top of the box, and having an interior sized and shaped to receive ammunition. A pair of opposite lips extends from opposite sides of the open top and over the open top of the box, and has a narrower gap between distal free ends of the pair of lips with respect to a wider width of the box between the sides of the box. A follower is slidably disposed in the box and has a path of travel substantially along the longitudinal axis, and a stroke from an intermediate location of the box defining a loaded position, to the open top defining an unloaded position. The follower substantially spans the interior of the box. A spring is disposed between the bottom and the follower, and biases the follower towards the open top. The spring is compressible between the bottom and the follower as ammunition is inserted into the box, and biases the ammunition against the pair of lips. The box and the pair of lips comprise a composite material comprising fibers in a resin matrix. The sides of the box comprise more hoop fibers than the pair of lips in a hoop direction laterally around the box with respect to the longitudinal axis. A majority of fibers in the sides of the box is oriented in the hoop direction. The pair of lips comprises more axial fibers than the sides of the box in an axial direction substantially along the longitudinal axis. A majority of fibers in the pair of lips is oriented in the axial direction. The axial fibers of the pair of lips extend in an arc and are oriented in a direction extending from proximal ends of the pair of lips at the box, to the distal free ends of the pair of lips. The sides of the box comprise unidirectional hoop fibers. The pair of lips comprises unidirectional axial fibers. A pair of woven fabric layers with multi-directional fibers sandwich the unidirectional hoop fibers of the sides of the box and the unidirectional axial fibers of the pair of lips. The pair of fabric layers comprises an inner layer disposed inside the box and the pair of lips, and an outer layer disposed outside the box and the pair of lips. The pair of fabric layers extends continuously between the sides and the bottom of the box. The pair of fabric layers extends continuously between the sides of the box and the pair of lips. A tang or a notch is disposed in at least one of the sides of the box and is formed by the composite material continuously with the at least one side of the box.

Furthermore, the invention provides a composite ammunition magazine to hold ammunition for a firearm. The magazine comprises a box with a follower slidably disposed in the box and a spring disposed between a bottom of the box and the follower and biasing the follower towards an open top. A pair of opposite lips extends from proximal ends at opposite sides of the open top in an arc to distal free ends over the open top of the box. The box and the pair of lips comprise a composite material comprising fibers in a resin matrix. The sides of the box comprise hoop fibers oriented at 0 degrees and axial fibers oriented at 90 degrees. The pair of lips comprises lateral fibers oriented at 0 degrees and arc fibers extending in an arc and oriented at 90 degrees with respect to the lateral fibers. The pair of lips comprises more arc fibers than the axial fibers in the box.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Shooting is a popular sport and some shooters enjoy customizing and/or improving their firearms. In addition, some shooters actively seek to lighten the weight and/or improve the strength of their firearms and/or firearm accessories. It has been recognized that it would be advantageous to develop an ammunition magazine with reduces weight, and/or increased strength. In addition, it has been recognized that it would be advantageous to develop a composite ammunition magazine. Furthermore, it has been recognized that it would be advantageous to provide different parts of the magazine with different or greater strength in different directions. For example, it has been recognized that the lips of the magazine require greater strength against deflection to resist movement due to their cantilever nature, while the box requires greater strength in the hoop direction to resist bowing or expanding.

The invention provides a light-weight, high-strength composite ammunition magazine that can hold ammunition for a firearm, while providing sufficient strength, and lighter weight, utilizing fiber (such as carbon fiber) in a resin matrix. The lips of the box can have a majority of fibers oriented in an axial or arc direction (or in an arc generally or substantially in the axial direction) or 90 degrees, while the sides of the box can have a majority of fibers oriented in the hoop direction or 0 degrees. The lips can have more axial fibers (or arc fibers) than the sides of the box, while the sides of the box can have more hoop fibers than the lips (or lateral fibers oriented at 0 degrees). The lips can have unidirectional axial or arc fibers sandwiched between woven fabric layers, while the sides of the box can have unidirectional hoop fibers sandwiched between woven fabric layers. The woven fabric layers can extend continuously between the sides of the box and the lips. Similarly, the woven fabric layers can extend continuously between the sides of the box and a bottom of the box.

Figure 1:
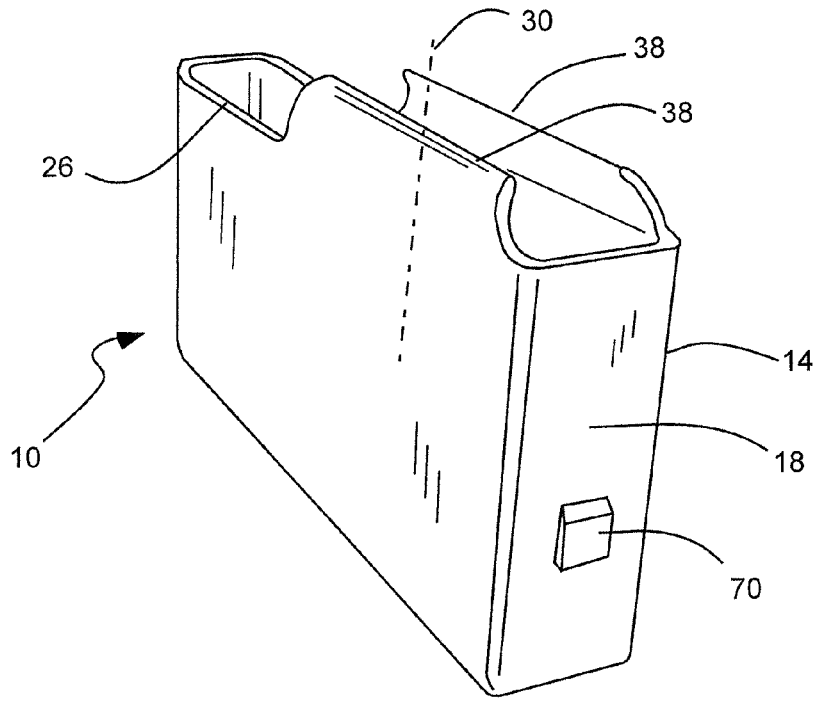
FIG. 1 is a perspective view of an ammunition magazine for a firearm in accordance with an embodiment of the present invention.
Figure 7:
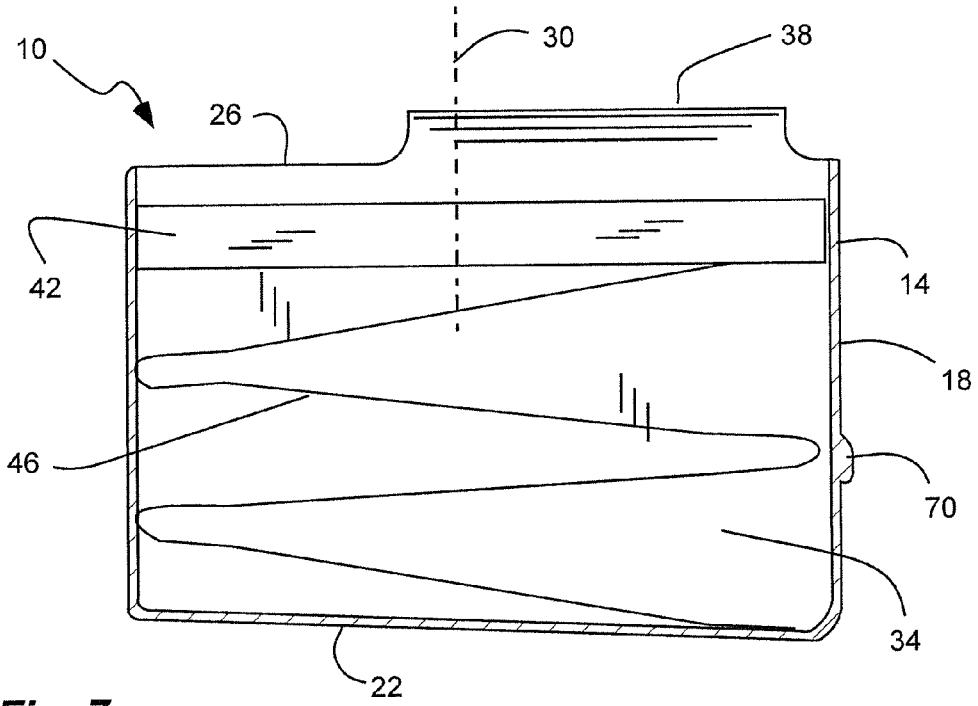
FIG. 7 is a cross-sectional side view of the ammunition magazine of FIG. 1, taken along line 7 of FIG. 4.
Figure 4:
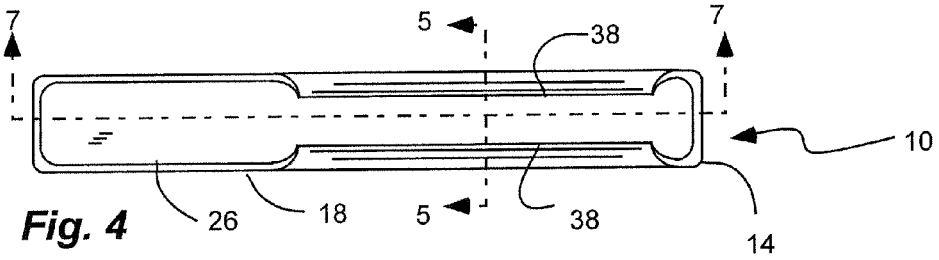
FIG. 4 is a top view of the ammunition magazine of FIG. 1.
Figure 2:
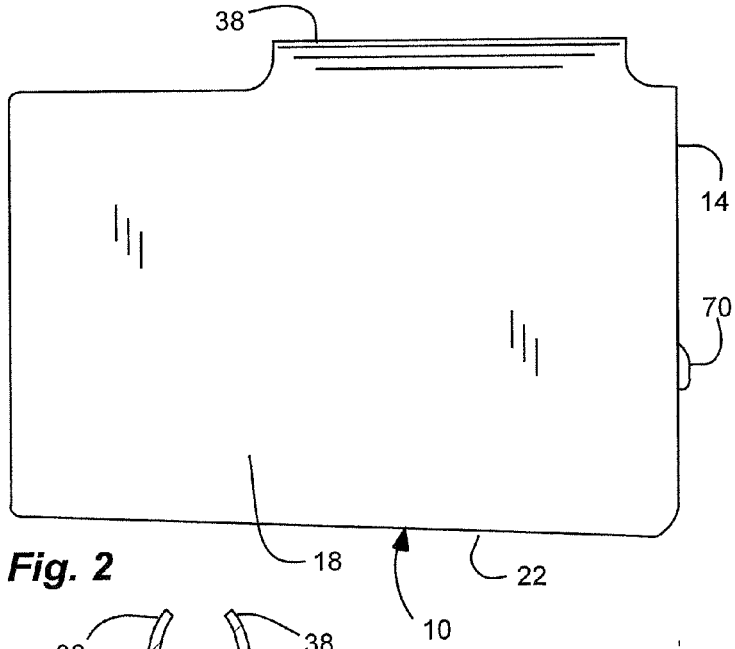
FIG. 2 is a side view of the ammunition magazine of FIG. 1.
Figure 3:
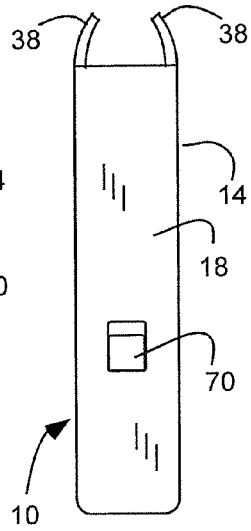
FIG. 3 is an end view of the ammunition magazine of FIG. 1.
Figure 5:
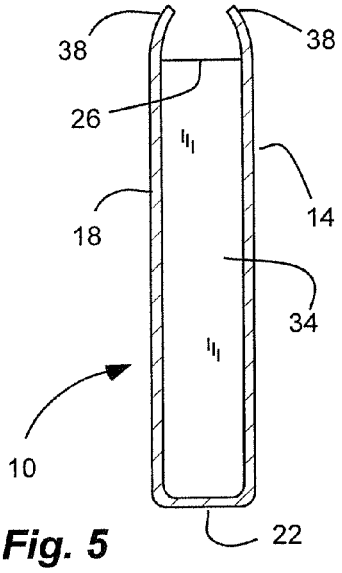
FIG. 5 is a cross-sectional end view of the ammunition magazine of FIG. 1, taken along line 5 of FIG. 4.
Figure 6:
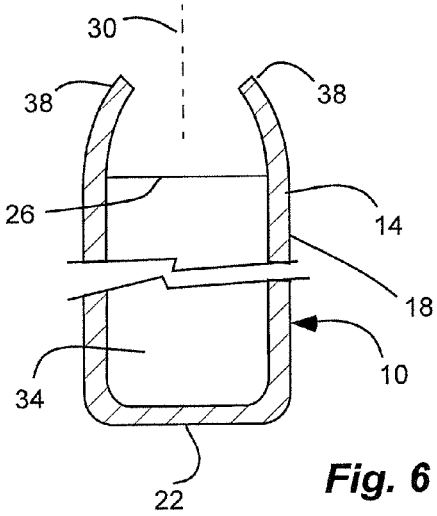
FIG. 6 is a detailed cross-sectional end view of the ammunition magazine of FIG. 1.
Figure 8:
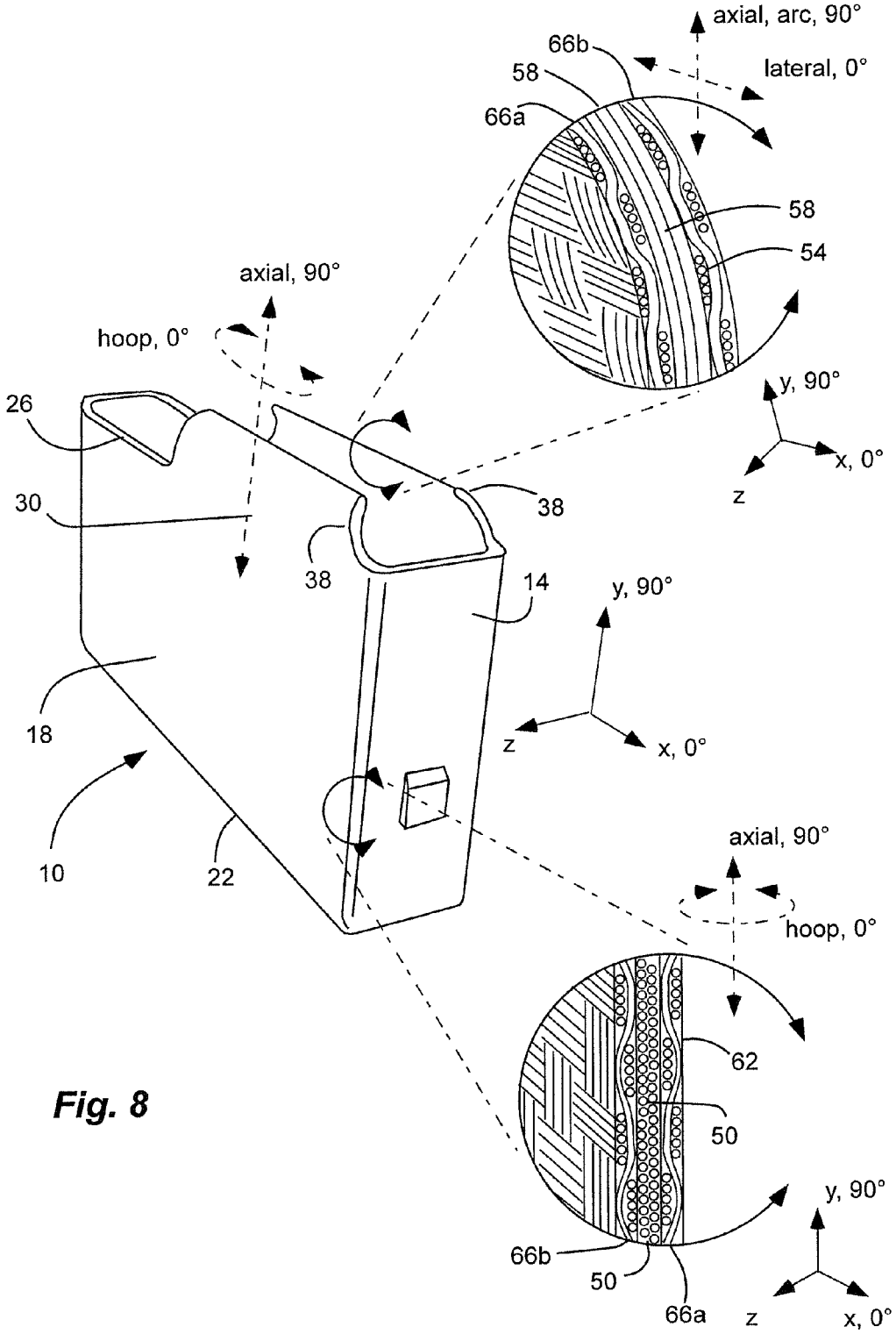
FIG. 8 is a schematic view of the ammunition magazine of FIG. 1.

As illustrated in FIGS. 1-8, an ammunition magazine, indicated generally at 10, in an example implementation in accordance with the invention is shown to hold ammunition for a firearm. Thus, the box can have a size and shape to hold a select cartridge and quantity of ammunition with an opening in the top to allow for select ejection or withdrawal of a cartridge at the opening. The magazine can have a box 14 with sides 18 and bottom 22. The sides and bottom can be substantially enclosed, or even completely enclosed, and can have side walls and a bottom wall. Openings can be formed in the walls to allow observation of the ammunition therein, such as to determine the quantity of ammunition therein. In addition, the box can have an open top 26 or opening in the top. The designation of top and bottom is with respect to the magazine which is usually oriented with a closed end as the bottom and an open end as a top. But it will be appreciated that in use, the opening and the bottom can be oriented laterally or to the side, or the opening can be oriented downwardly and the bottom can be oriented upwardly. The magazine and the box have an exterior sized and shaped to be inserted into a firearm. The box can also have and/or define a longitudinal axis 30 that extends through the bottom and open top of the box. Again, the box can have an interior 34 sized and shaped to receive ammunition of a desired quantity and caliber. The ammunition can be stacked in the box with one over another. Alternatively, the ammunition can be stacked in the box with one over and to the side of another. The box can have a long side and a narrow side depending on the length of the ammunition and how it is stacked in the box.

The magazine 10 and/or the box 14 can have a pair of opposite lips 38 extending from opposite sides of the open top 26 and over the open top of the box. The lips can extend from the long sides of the box out away from the box along the longitudinal axis and the open top, and inward towards the longitudinal axis and the open top. The lips can have a proximal end at the box, or at the sides of the box at the open end, and extending to distal free ends over the open end. The lips can have an arcuate shape, and can extend in an arc between the proximal and distal ends. The lips, or distal free ends thereof, can have or can define a narrower gap between distal free ends of the pair of lips, with respect to a wider width of the box between the sides of the box. The narrower gap can be spaced-apart from the opening of the box at tops of the sides. Thus, the lips act to retain the ammunition in the box in a longitudinal direction, while allowing the ammunition to be selectively slid out of the opening and from between the lips in a lateral direction.

The magazine 10 and/or the box 14 can have a follower 42 slidably disposed in the interior of the box. The follower can have a path of travel substantially along the longitudinal axis between the bottom 22 and the open top 26. The follower can have a stroke from an intermediate location of the box, defining a loaded position with the ammunition therein, to the open top, defining an unloaded position without the ammunition therein. In addition, the follower can substantially spanning the interior of the box. The follower can be formed of plastic, such as by injection molding. A spring 46 is disposed between the bottom 22 and the follower 42, and biases the follower, and thus the ammunition, towards the open top. The spring can be compressible between the bottom and the follower as ammunition is inserted into the box, and biases the ammunition against the pair of lips 38. The spring can be metal and can be any type of spring, such as a coil spring, or a leaf spring, etc.

The box 14 and the pair of lips 38 can comprise or can be formed of a composite material, comprising fibers in a resin matrix. For example, the fibers can be carbon fibers. Thus, the magazine can be strong and light weight. In addition, it has been recognized that the magazine has different sections or portions subject to different stress; and thus the magazine can be optimized for weight reduction and strength. The sides 18 of the box 14 can comprise more lateral or hoop fibers 50 (oriented at 0 degrees, or laterally in the x and z direction with respect to the longitudinal axis) than the pair of lips (or lateral fibers 54 in the pair of lips oriented laterally in the x direction); with the hoop fibers 50 of the walls oriented in a hoop direction laterally around the box with respect to the longitudinal axis (oriented at 0 degrees, or laterally in the x and z direction with respect to the longitudinal axis). The pair of lips 38 comprise more axial or arc fibers 58 (oriented generally 90 degrees, or axially in the y direction) than the sides 18 of the box (or axial fibers 62 in the sides of the box oriented axially in the y direction); with the axial or arc fibers 58 of the lips oriented in an axial direction substantially along the longitudinal axis (oriented generally 90 degrees, or axially in the y direction). The axial or arc fibers 58 of the pair of lips 38 extend generally axially, but also extend in an arc oriented at 90 degrees with respect to lateral fibers 54. The axial or arc fibers 58 of the pair of lips 38 can extend in an arc, and are oriented in a direction extending from proximal ends of the pair of lips at the box, to the distal free ends of the pair of lips.

In addition, a majority of fibers in the sides 18 of the box 14 can be oriented in the hoop direction, or lateral direction (oriented at 0 degrees, or laterally in the x and z direction with respect to the longitudinal axis). Thus, the sides 18 of the box 14 can have more lateral or hoop fibers 50 (oriented at 0 degrees in the x and z direction) than axial fibers 62 (oriented at 90 degrees in the y direction). Furthermore, a majority of fibers in the pair of lips 38 can be oriented in the axial direction (oriented generally 90 degrees, or axially in the y direction). Thus, lips 38 can have more axial or arc fibers 58 (oriented at 90 degrees in the y direction) than lateral fibers (oriented at 0 degrees in the x direction).

The sides 18 of the box 14 can comprise unidirectional hoop fibers 50, or a layer of unidirectional hoop fibers. Similarly, the pair of lips 38 can comprise unidirectional axial or arc fibers 58, or a layer of unidirectional axial or arc fibers. A pair of fabric layers 66*a* and 66*b* with multi-directional fibers can sandwich the unidirectional hoop fibers of the sides 18 of the box and the unidirectional axial fibers of the pair of lips 38, or unidirectional layers thereof. The pair of fabric layers can comprise an inner layer 66*a* disposed inside the box and the pair of lips, and an outer layer 66*b* disposed outside the box 14 and the pair of lips 38. The pair of fabric layers can extend continuously between the sides 18 of the box 14 and the bottom 22 of the box. Similarly, the pair of fabric layers can extend continuously between the sides 18 of the box 14 and the pair of lips 38. The multi-directional fibers of the fabric layers 66*a* and 66*b* can comprise axial fibers oriented in the axial direction (90 degrees along the y axis), and hoop fibers or lateral fibers oriented in the hoop direction or lateral direction (0 degrees along the x and z direction). Thus, the sides 18 of the box can comprise hoop fibers oriented at 0 degrees and axial fibers oriented at 90 degrees. Similarly, the pair of lips 38 can comprise lateral fibers oriented at 0 degrees and arc fibers extending in an arc and oriented at 90 degrees with respect to the lateral fibers. Within each of the pair of layers, the axial fibers and the hoop fibers can be woven together.

The magazine 10 and/or the box 14 can have a tang 70 or a notch disposed on at least one of the sides 18 of the box. The tang or notch can be engaged by the firearm to retain the magazine in the firearm. The tang or notch can be formed by the composite material continuously with the at least one side of the box.

To make the magazine, the material (the fibers including the unidirectional and woven fabric fiber layers) is wrapped around a male mold (which can be formed of silicon and can be multi-piece) that applies pressure when under heat up, which forces consolidation of the fibers against a female mold into which the male mold is inserted with the material/fibers thereon. It has a secondary benefit of stretching the fibers to align them and take out waves or kinks. The female mold can be multi-piece.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A composite ammunition magazine device configured to hold ammunition for a firearm, the device comprising:

a) a box with sides and bottom, and an open top, and defining a longitudinal axis through the bottom and open top of the box, and having an interior sized and shaped to receive ammunition;

b) a pair of opposite lips extending from opposite sides of the open top and over the open top of the box and having a narrower gap between distal free ends of the pair of lips with respect to a wider width of the box between the sides of the box;

c) a follower slidably disposed in the box and having a path of travel substantially along the longitudinal axis;

d) a spring disposed between the bottom and the follower and biasing the follower towards the open top;

e) the box and the pair of lips comprising a composite material comprising fibers in a resin matrix;

f) the sides of the box comprising more hoop fibers than the pair of lips in a hoop direction laterally around the box with respect to the longitudinal axis; and g) the pair of lips comprising more axial fibers than the sides of the box in an axial direction substantially along the longitudinal axis.

2. The device in accordance with claim 1, wherein the axial fibers of the pair of lips extend in an arc and are oriented in a direction extending from proximal ends of the pair of lips at the box, to the distal free ends of the pair of lips.

3. The device in accordance with claim 1, wherein a majority of fibers in the sides of the box are oriented in the hoop direction.

4. The device in accordance with claim 1, wherein a majority of fibers in the pair of lips are oriented in the axial direction.

5. The device in accordance with claim 1, further comprising:

the sides of the box comprising unidirectional hoop fibers;

the pair of lips comprising unidirectional axial fibers; and a pair of fabric layers with multi-directional fibers sandwiching the unidirectional hoop fibers of the sides of the box and the unidirectional axial fibers of the pair of lips.

6. The device in accordance with claim 5, further comprising:

the pair of fabric layers comprising an inner layer disposed inside the box and the pair of lips, and an outer layer disposed outside the box and the pair of lips.

7. The device in accordance with claim 5, further comprising:

the pair of fabric layers extending continuously between the sides and the bottom of the box.

8. The device in accordance with claim 5, further comprising:

the pair of fabric layers extending continuously between the sides of the box and the pair of lips.

9. The device in accordance with claim 5, further comprising:

the multi-directional fibers of the fabric layers comprising axial fibers oriented in the axial direction and hoop fibers oriented in the hoop direction, with the axial fibers and the hoop fibers of each of the fabric layers woven together.

10. The device in accordance with claim 1, further comprising:

a tang or a notch disposed on at least one of the side of the box and formed by the composite material continuously with the at least one side of the box.

11. A composite ammunition magazine device configured to hold ammunition for a firearm, the device comprising:

a) a box with substantially enclosed sides and bottom, and an open top, and defining a longitudinal axis through the bottom and the open top of the box, and having an interior sized and shaped to receive ammunition;

b) a pair of opposite lips extending from opposite sides of the open top and over the open top of the box and having a narrower gap between distal free ends of the pair of lips with respect to a wider width of the box between the sides of the box;

c) a follower slidably disposed in the box and having a path of travel substantially along the longitudinal axis and a stroke from an intermediate location of the box defining a loaded position, to the open top defining an unloaded position, the follower substantially spanning the interior of the box;

d) a spring disposed between the bottom and the follower and biasing the follower towards the open top, the spring being compressible between the bottom and the follower as ammunition is inserted into the box, and biasing the ammunition against the pair of lips;

e) the box and the pair of lips comprising a composite material comprising fibers in a resin matrix;

f) the sides of the box comprising more hoop fibers than the pair of lips in a hoop direction laterally around the box with respect to the longitudinal axis, with a majority of fibers in the sides of the box being oriented in the hoop direction;

g) the pair of lips comprising more axial fibers than the sides of the box in an axial direction substantially along the longitudinal axis, with a majority of fibers in the pair of lips being oriented in the axial direction;

h) the axial fibers of the pair of lips extend in an arc and oriented in a direction extending from proximal ends of the pair of lips at the box, to the distal free ends of the pair of lips;

i) the sides of the box comprising unidirectional hoop fibers;

j) the pair of lips comprising unidirectional axial fibers;

k) a pair of woven fabric layers with multi-directional fibers sandwiching the unidirectional hoop fibers of the sides of the box and the unidirectional axial fibers of the pair of lips;

l) the pair of fabric layers comprising an inner layer disposed inside the box and the pair of lips, and an outer layer disposed outside the box and the pair of lips;

m) the pair of fabric layers extending continuously between the sides and the bottom of the box;

n) the pair of fabric layers extending continuously between the sides of the box and the pair of lips; and o) a tang or a notch disposed in at least one of the sides of the box and formed by the composite material continuously with the at least one side of the box.

12. A composite ammunition magazine device configured to hold ammunition for a firearm, the device comprising:

a) a box with a follower slidably disposed in the box and a spring disposed between a bottom of the box and the follower and biasing the follower towards an open top;

b) a pair of opposite lips extending from proximal ends at opposite sides of the open top in an arc to distal free ends over the open top of the box;

c) the box and the pair of lips comprising a composite material comprising fibers in a resin matrix with the sides of the box comprising hoop fibers oriented at 0 degrees and axial fibers oriented at 90 degrees, and the pair of lips comprising lateral fibers oriented at 0 degrees and arc fibers extending in an arc and oriented at 90 degrees with respect to the lateral fibers; and d) the pair of lips comprising more arc fibers than the axial fibers in the box.

13. The device in accordance with claim 12, wherein a majority of fibers in the pair of lips are arc fiber.

14. The device in accordance with claim 12, wherein the box comprises more hoop fibers than the lateral fibers of the pair of lips.

15. The device in accordance with claim 12, wherein a majority of fibers in the sides of the box are oriented in the hoop direction.

16. The device in accordance with claim 12, further comprising:

the sides of the box comprising unidirectional hoop fibers;

the pair of lips comprising unidirectional arc fibers; and a pair of fabric layers with multi-directional fibers sandwiching the unidirectional hoop fibers of the sides of the box and the unidirectional arc fibers of the pair of lips.

17. The device in accordance with claim 16, further comprising:

the pair of fabric layers comprising an inner layer disposed inside the box and the pair of lips, and an outer layer disposed outside the box and the pair of lips.

18. The device in accordance with claim 16, further comprising:

the pair of fabric layers extending continuously between the sides and the bottom of the box.

19. The device in accordance with claim 16, further comprising:

the pair of fabric layers extending continuously between the sides of the box and the pair of lips.

20. The device in accordance with claim 16, further comprising:

the multi-directional fibers of the fabric layers comprising axial fibers oriented at 90 degrees and hoop fibers oriented at 0 degrees, with the axial fibers and the hoop fibers of each of the fabric layers woven together.

* * * * *